US011278115B1

(12) United States Patent
Chen

(10) Patent No.: US 11,278,115 B1
(45) Date of Patent: Mar. 22, 2022

(54) STORAGE RACK

(71) Applicant: Ching-Yi Chen, Changhua County (TW)

(72) Inventor: Ching-Yi Chen, Changhua County (TW)

( * ) Notice: Subject to any disclaimer, the term of this patent is extended or adjusted under 35 U.S.C. 154(b) by 0 days.

(21) Appl. No.: 17/066,346

(22) Filed: Oct. 8, 2020

(51) Int. Cl.
*A47B 47/00* (2006.01)
*A47B 47/02* (2006.01)
*A47B 46/00* (2006.01)

(52) U.S. Cl.
CPC ..... *A47B 47/024* (2013.01); *A47B 46/005* (2013.01)

(58) Field of Classification Search
CPC . A47B 47/024; A47B 46/005; A47B 87/0207; A47B 23/001; A47B 2200/0033; A47B 55/02
USPC .... 312/107, 108, 111; 108/180, 181, 92, 91, 108/153, 125, 127, 126, 129–132; 211/188, 149, 181.1, 74, 126.8, 126.9, 211/133.2, 133.5, 41.4, 85.13, 90.03, 106, 211/112, 119, 194; 248/175, 439
See application file for complete search history.

(56) References Cited

U.S. PATENT DOCUMENTS 2,975,906 A * 3/1961 Van Der Togt ..... A47L 19/04 211/74
3,703,872 A * 11/1972 Barrevecchia ..... A47B 13/16 108/179
4,434,899 A * 3/1984 Rivkin ..... H05K 13/0069 206/707
5,035,335 A * 7/1991 Massoudnia ..... A47B 87/0207 211/188
5,074,223 A * 12/1991 Remmers ..... A47B 43/00 108/91
5,097,971 A * 3/1992 Norris ..... A47B 87/0207 211/126.6
6,318,570 B1 * 11/2001 Mueller ..... A47B 87/0207 211/126.7
6,561,107 B1 * 5/2003 Wood ..... A47B 3/0812 108/132
D927,902 S * 8/2021 Sabounjian ..... D6/675.5

* cited by examiner

*Primary Examiner* — Janet M Wilkens
(74) *Attorney, Agent, or Firm* — Chun-Ming Shih; Lanway IPR Services

(57) ABSTRACT

A storage rack contains: a rectangular platform, two support feet, a rectangular plane, two long fringes, two short fringes, four circular orifices, four oval orifices, and two grips which. The two support feet are connected on the rectangular platform, and a respective support foot has a first inward bending portion and a second inward bending portion which are formed on two free ends of two tops of the respective support foot. Each of the first inward bending portion and the second inward bending portion has an arcuate face and an insertion, the arcuate face corresponds to a respective oval orifice of a respective long fringe of the rectangular platform, and the insertion corresponds to a respective circular orifice of the respective long fringe of the rectangular platform, such that the insertion is rotatably accommodated into the respective circular orifice to expand or retract the respective support foot freely.

10 Claims, 10 Drawing Sheets

STORAGE RACK

FIELD OF THE INVENTION

The present invention relates to a storage rack which is applied to place objects, two support feet are fixed securely by mating with two long fringes, and the storage rack is capable of being stacked on another storage rack firmly.

BACKGROUND OF THE INVENTION

A conventional storage rack is connected fixedly, so it cannot be retracted, delivered, portable, and stored easily. Furthermore, multiple conventional storage racks cannot be stacked firmly.

The present invention has arisen to mitigate and/or obviate the afore-described disadvantages.

SUMMARY OF THE INVENTION

The primary aspect of the present invention is to provide a storage rack by which the arcuate face of the respective support foot is received into the respective oval orifice so as to expand or retract the respective support foot, when the respective support foot is erected vertically.

Another aspect of the present invention is to provide a storage rack by which when stacking multiple storage racks, the closed extension of the respective support foot of a first storage rack is inserted into the respective grip of a second storage rack, such that the first storage rack is stacked on the second storage rack, thus stacking the multiple storage racks flexibility based on using requirements.

To obtain above-mentioned aspects, a storage rack provided by the present invention contains: a rectangular platform, two support feet, four circular orifices defined on two sides of two long fringes of the rectangular platform, four oval orifices outside the four circular orifices, and two grips mounted on the two short fringes. A U-shaped mouth of a respective grip faces downward.

The respective support foot has a closed extension extending outward, an arcuate face and an insertion which are formed on two free ends of two tops of the respective support foot, such that the insertion is rotatably accommodated into the respective circular orifice of the respective long fringe of the rectangular platform.

DETAILED DESCRIPTION OF THE PREFERRED EMBODIMENTS

Figure 1:
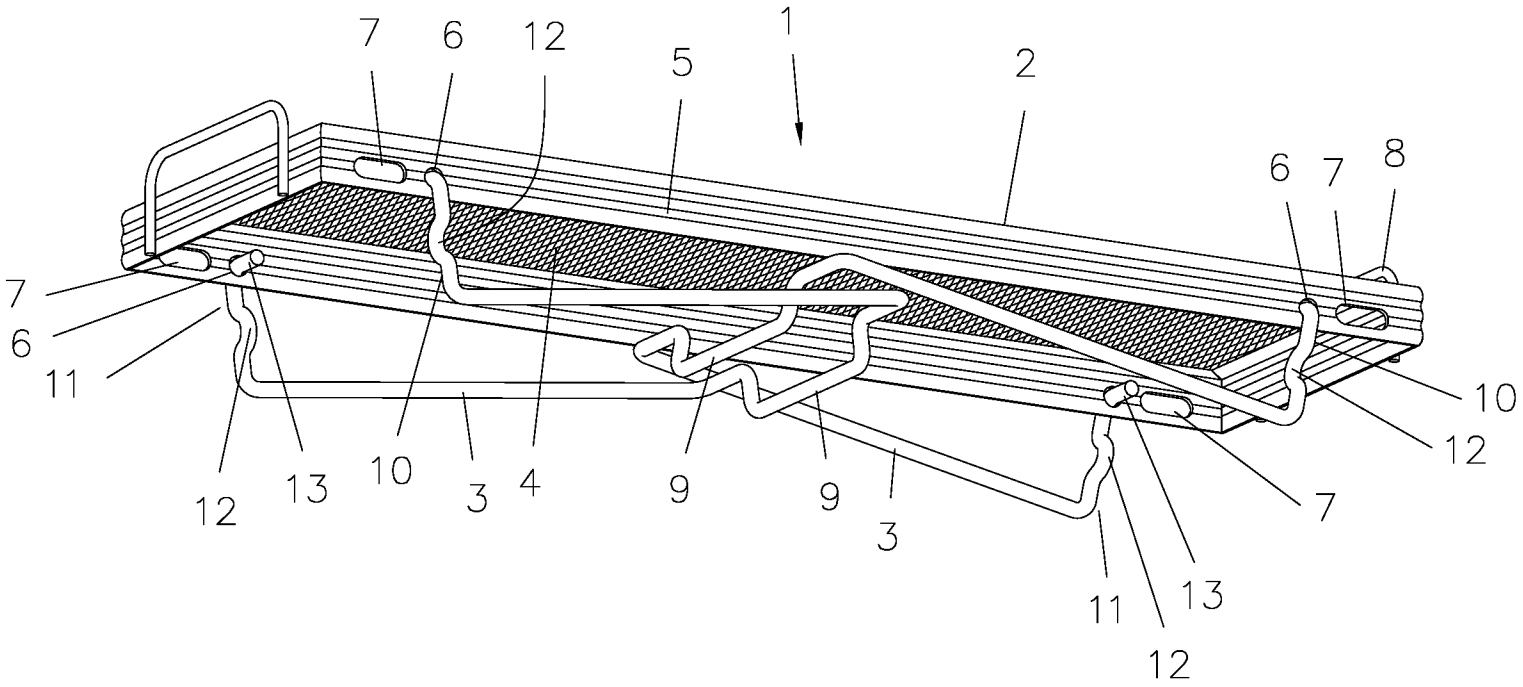
FIG. 1 is a perspective view showing the assembly of a storage rack according to a preferred embodiment of the present invention.
Figure 2:
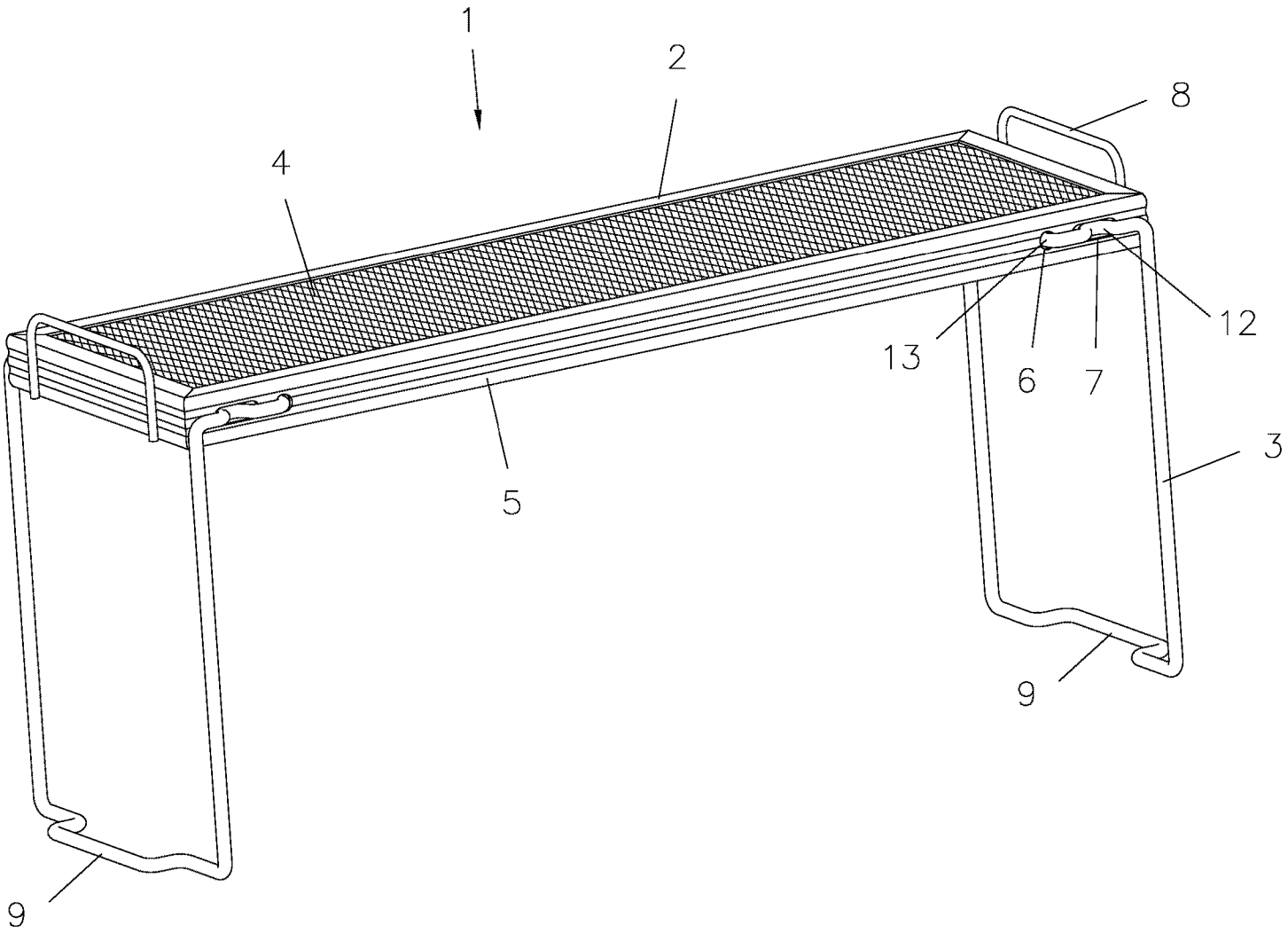
FIG. 2 is another perspective view showing the operation of the storage rack according to the preferred embodiment of the present invention.
Figure 3:
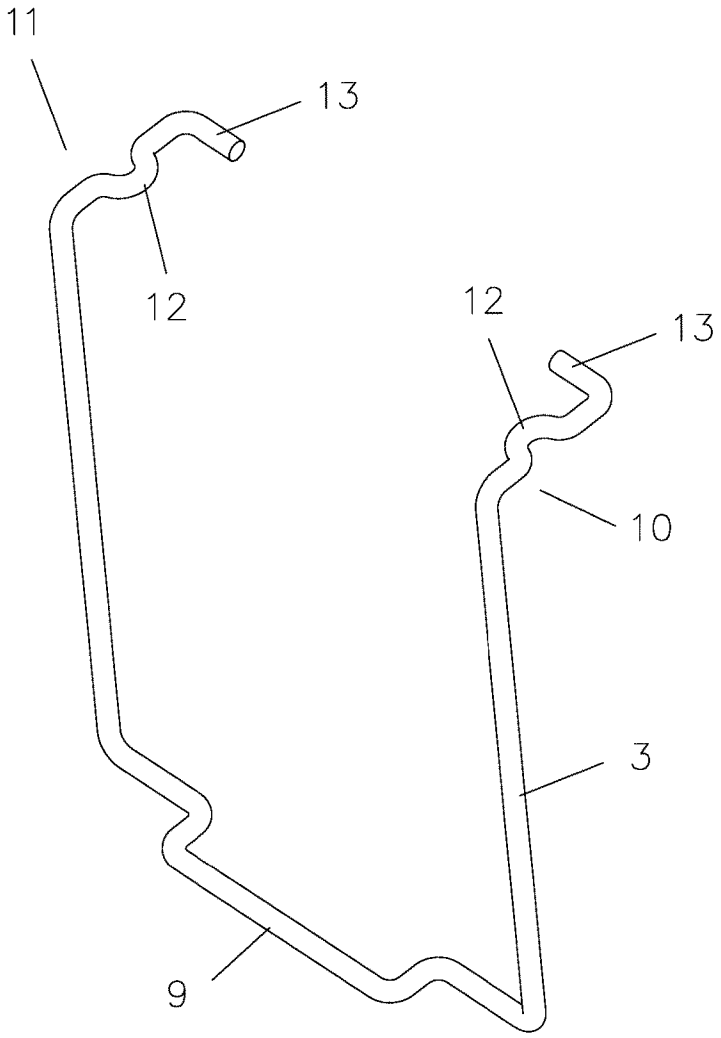
FIG. 3 is a perspective view showing the assembly of a support foot of the storage rack according to the preferred embodiment of the present invention.
Figure 4:
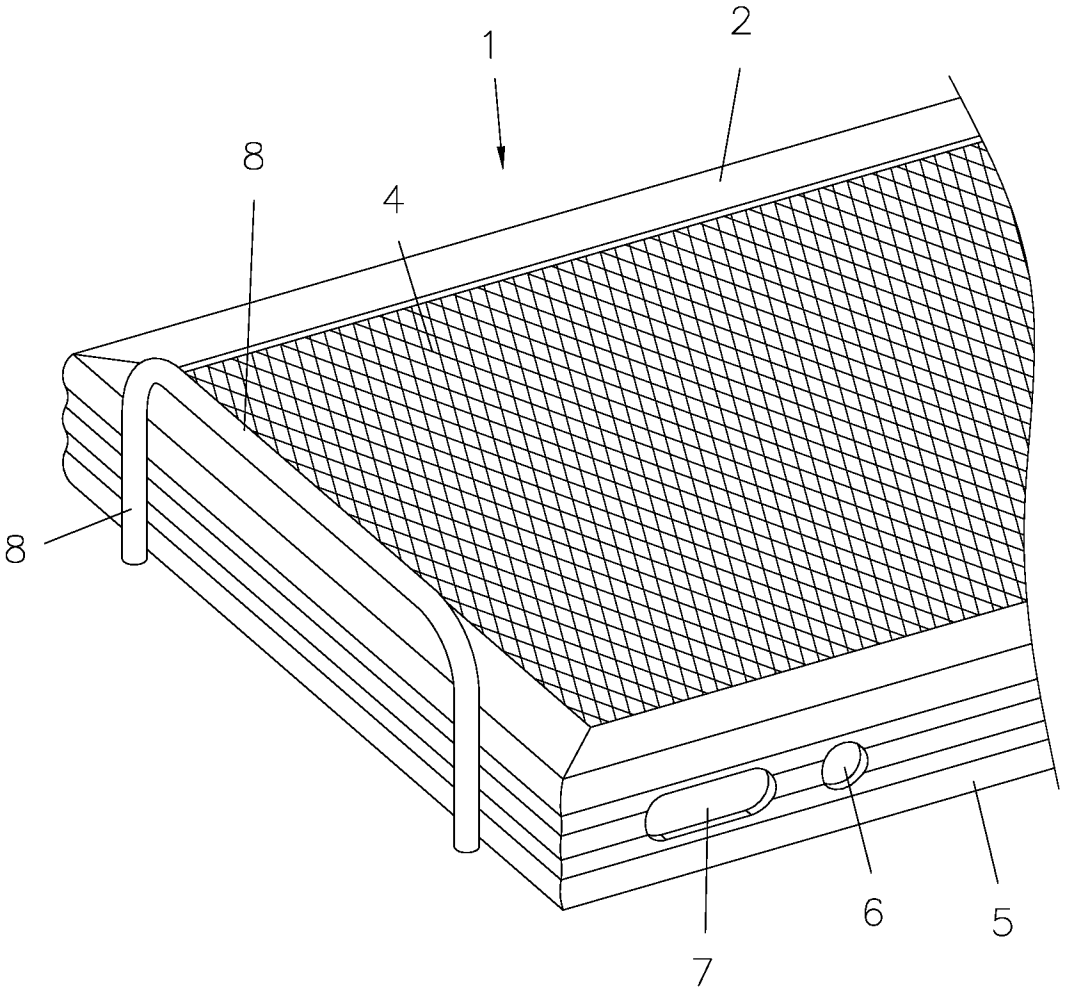
FIG. 4 is a perspective view showing the assembly of a part of a rectangular platform of the storage rack according to the preferred embodiment of the present invention.
Figure 5:
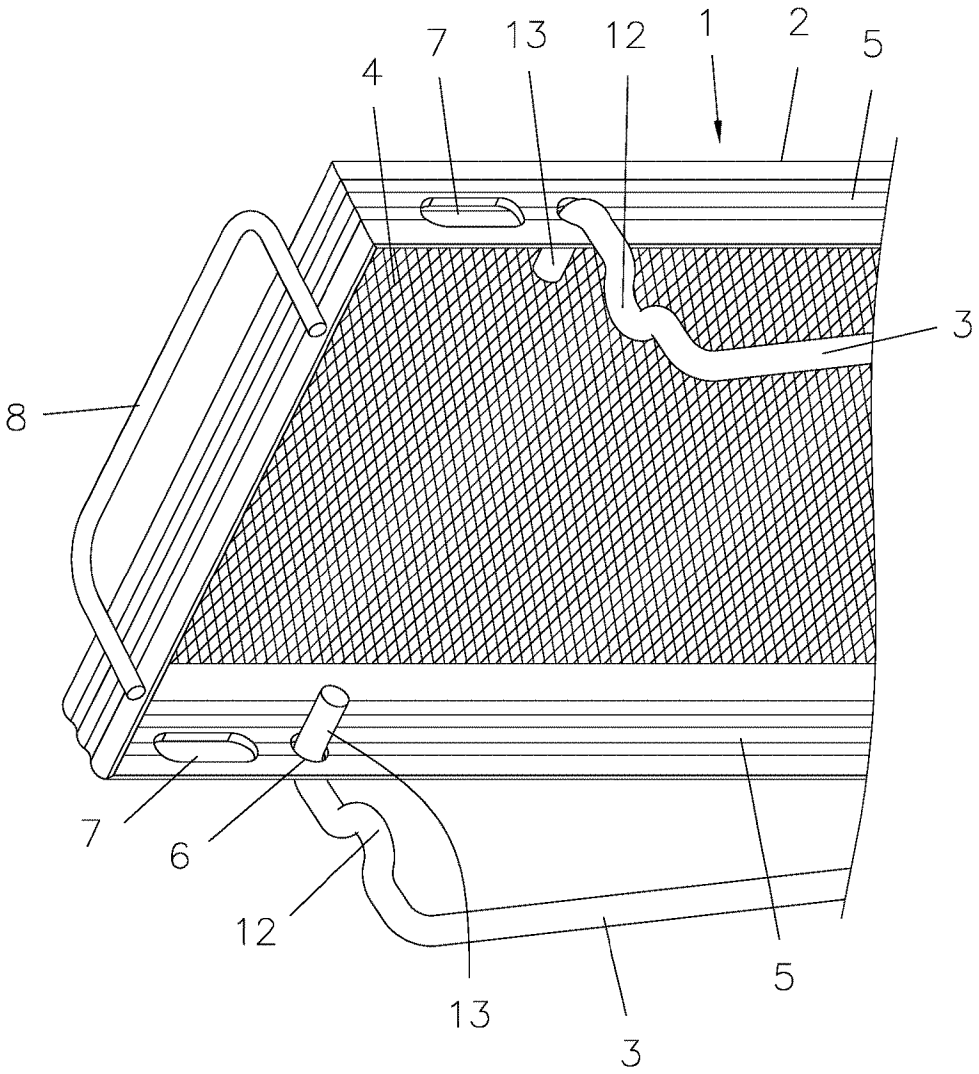
FIG. 5 is a perspective view showing the operation of a part of the support foot of the storage rack according to the preferred embodiment of the present invention.
Figure 6:
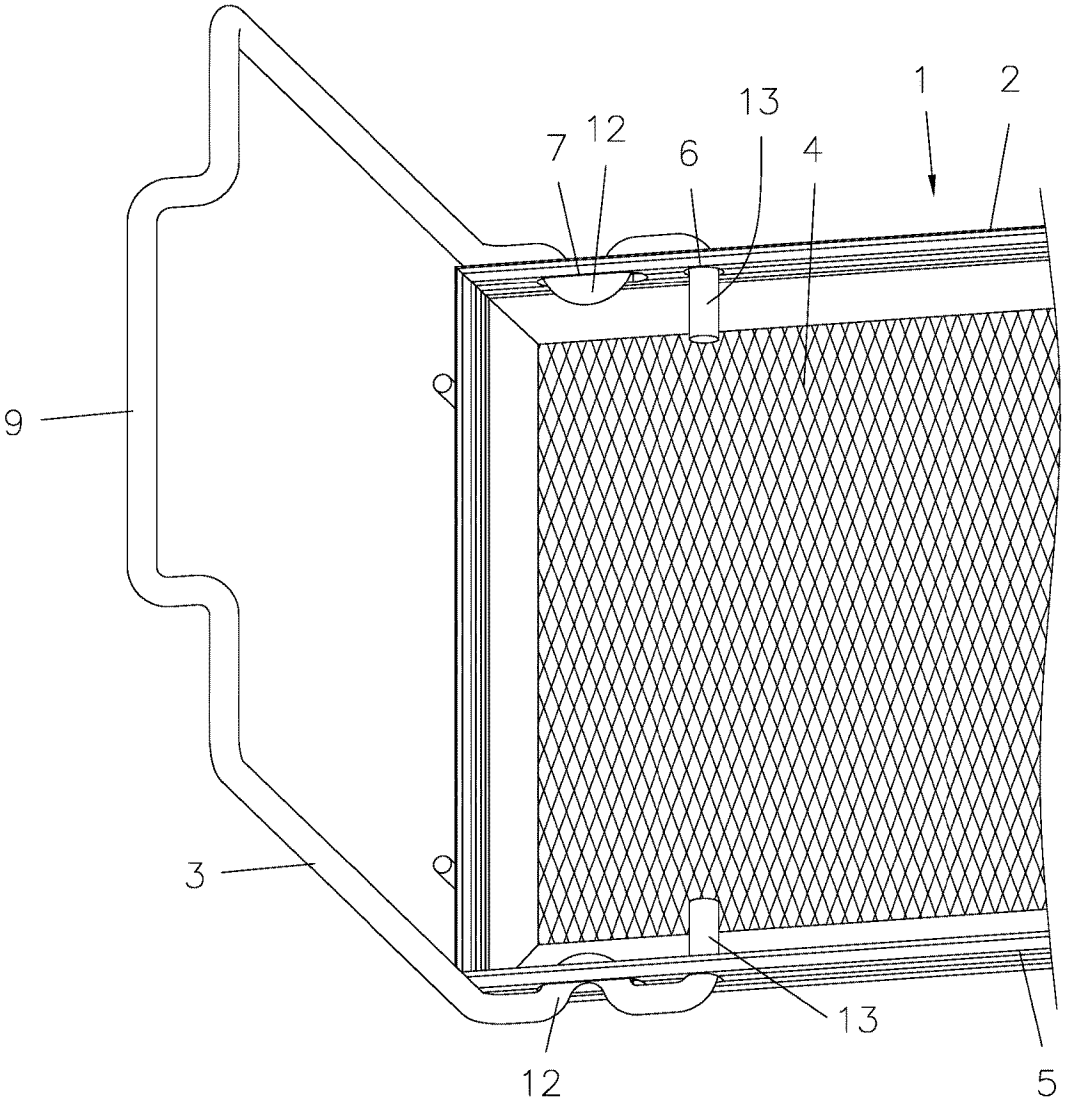
FIG. 6 is another perspective view showing the operation of the support foot of the storage rack according to the preferred embodiment of the present invention.
Figure 7:
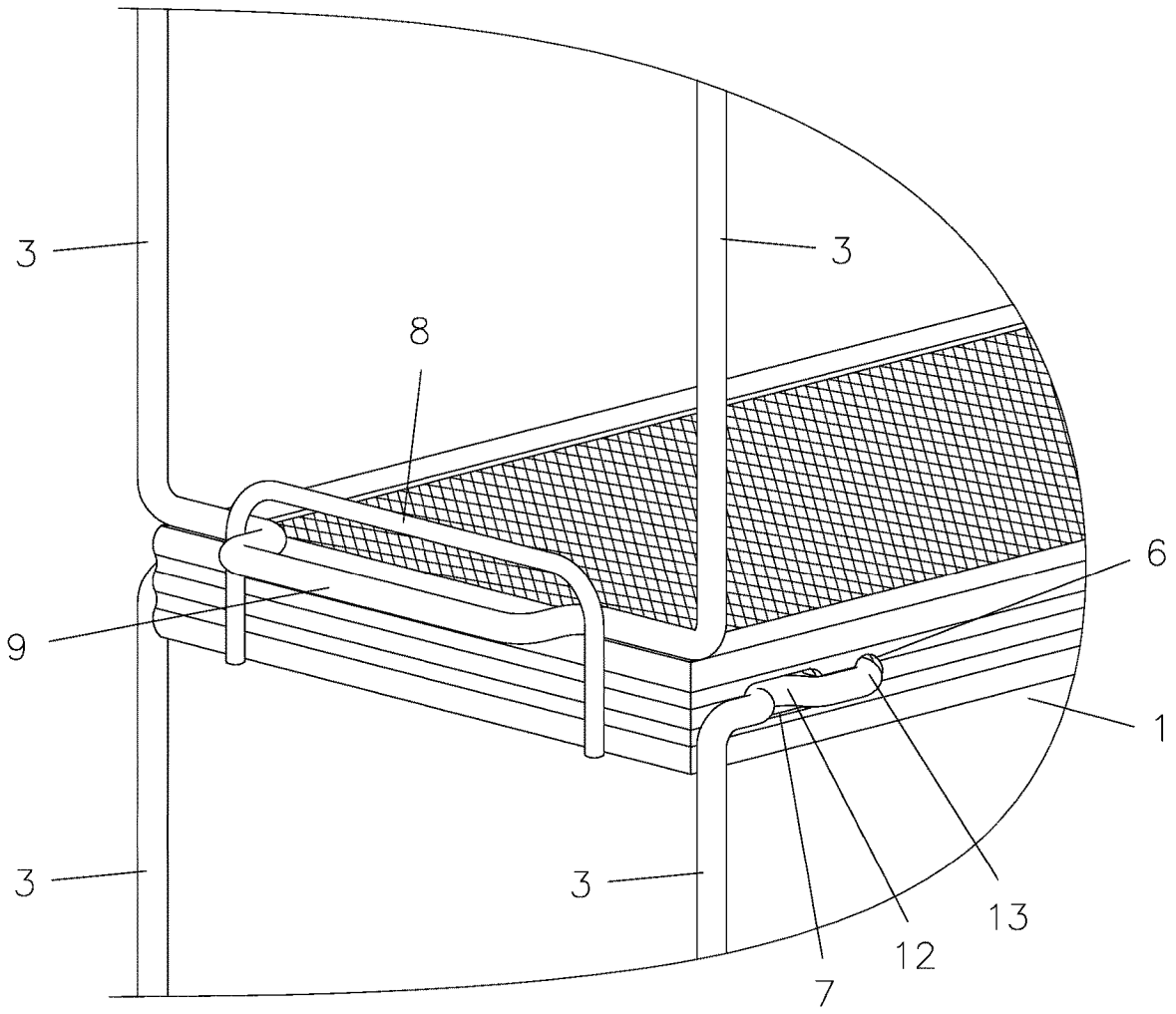
FIG. 7 is a perspective view showing the application of a part of the storage rack according to the preferred embodiment of the present invention.
Figure 8:
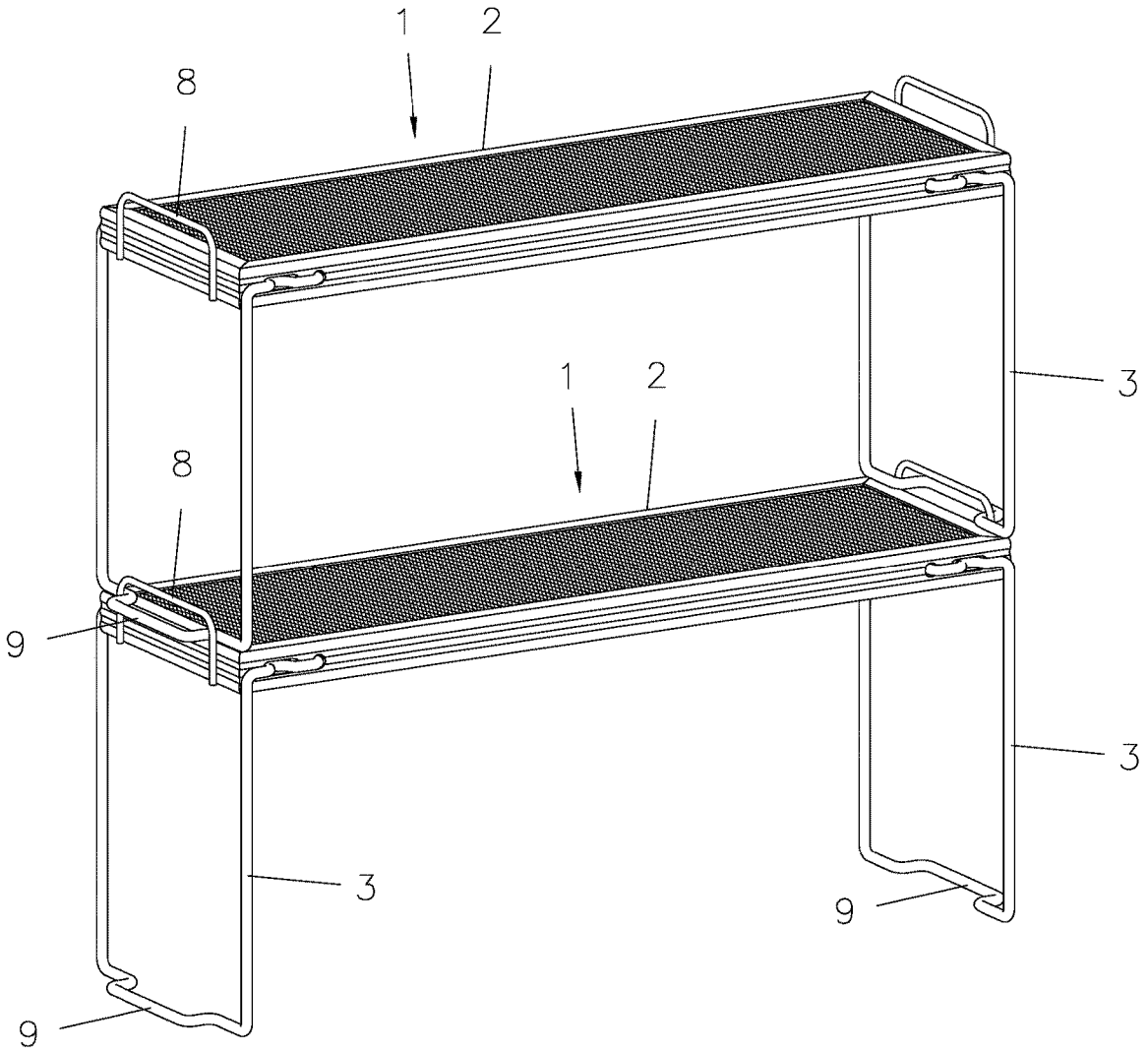
FIG. 8 is another perspective view showing the application of the storage rack according to the preferred embodiment of the present invention.

With reference to FIGS. 1-8, a storage rack 1 according to a preferred embodiment of the present invention comprises: a rectangular platform 2, two support feet 3, and a rectangular plane 4 formed on a top of the rectangular platform 2 and made of any one of a metal mesh, a wire mesh, and a metal plate. In this embodiment, the rectangular plane 4 is made of the metal mesh. The storage rack 1 further comprises: two long fringes 5 and two short fringes 5 which are formed on two long sides and two short sides of the rectangular platform 2 and made of a metal plate or other materials, four circular orifices 6 defined on two sides of the two long fringes 5 of the rectangular platform 2, and four oval or rectangular orifices 7 outside the four circular orifices 6, wherein a respective oval or rectangular orifice 7 is defined between a respective circular orifice 6 and a respective short fringe 5, and the storage rack 1 further comprises two grips 8 mounted on the two short fringes 5, wherein a U-shaped mouth of a respective grip 8 faces downward.

The two support feet 3 are connected on the two long sides of the rectangular platform 2, and a respective support foot 3 is made of a metal bar and is bent in an U shape, wherein the respective support foot 3 has a closed extension 9 extending outward and connected on two curved portions of the respective support foot 3, a first inward bending portion 10 and a second inward bending portion 11 which are formed on two free ends of two tops of the respective support foot 3, wherein each of the first inward bending portion 10 and the second inward bending portion 11 has an arcuate face 12 and an insertion 13, the arcuate face 12 is defined by two bent corners so as to be protruded with respect to the first inward bending portion 10 or the second inward bending portion 11, and the insertion 13 is bent inward with respect to a respective free end of a respective top of the respective support foot 3, wherein the arcuate face 12 corresponds to the respective oval or rectangular orifice 7 of a respective long fringe 5 of the rectangular platform 2, and the insertion 13 corresponds to the respective circular orifice 6 of the respective long fringe 5 of the rectangular platform 2, such that the insertion 13 is rotatably accommodated into the respective circular orifice 6 of the respective long fringe 5 of the rectangular platform 2 to expand or retract the respective support foot 3 freely. When the respective support foot 3 is erected vertically, the arcuate face 12 of the respective support foot 3 is received into the respective oval or rectangular orifice 7 of the respective long fringe 5. When the arcuate face 12 is movably removed from the respective oval or rectangular orifice 7, the respective support foot 3 is horizontally retracted onto a bottom of the rectangular platform 2, thus expending or retracting the respective support foot 3 of the storage rack 1 securely.

In application, when stacking multiple storage racks 1, the closed extension 9 of the respective support foot 3 of a first storage rack 1 is inserted into the respective grip 8 of a second storage rack 1, thus stacking the first storage rack 1 on the second storage rack 2. Accordingly, the multiple storage racks 1 are stacked flexibility based on using requirements.

Figure 9:
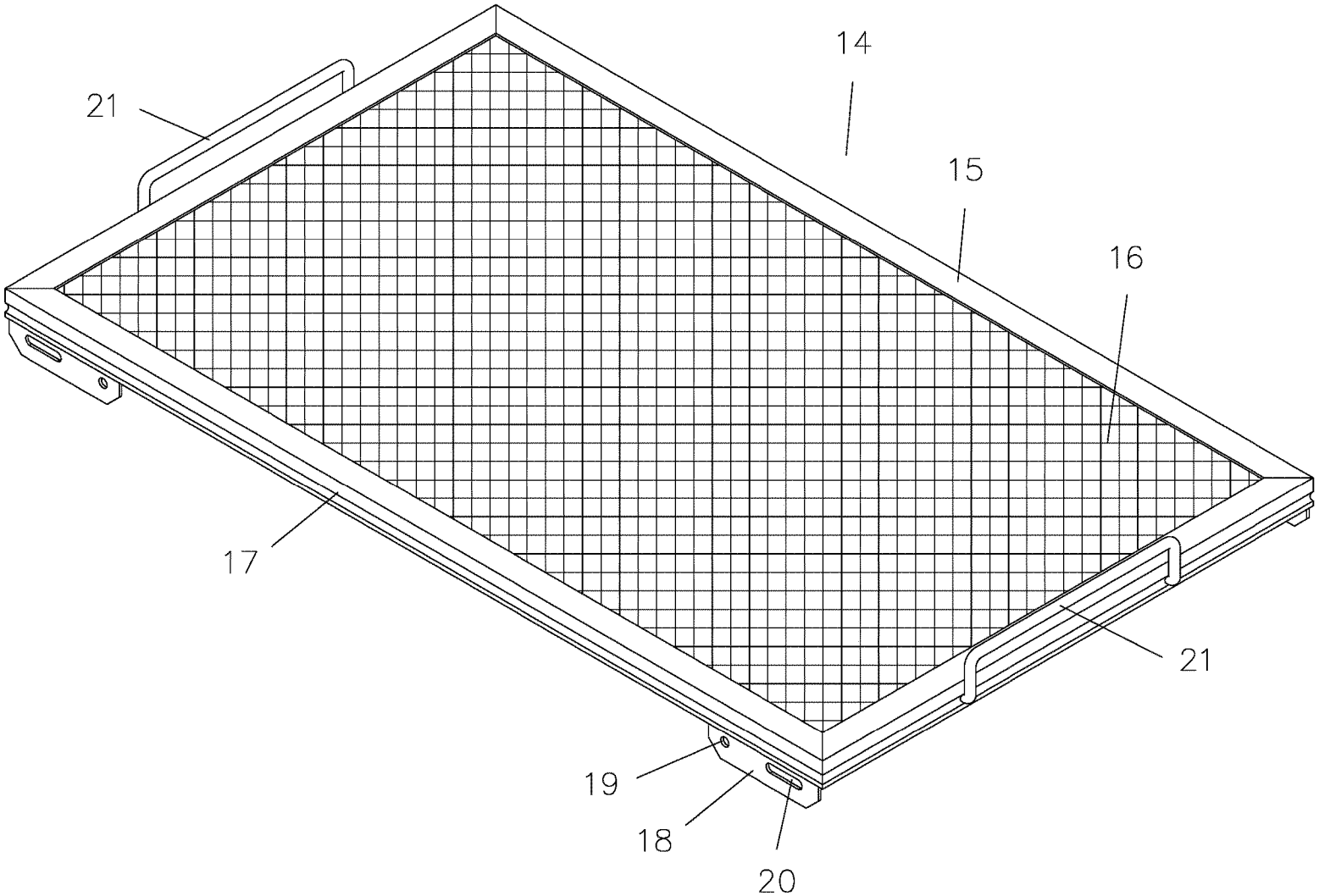
FIG. 9 is a perspective view showing the assembly of a rectangular platform of a storage rack according to another preferred embodiment of the present invention.
Figure 10:
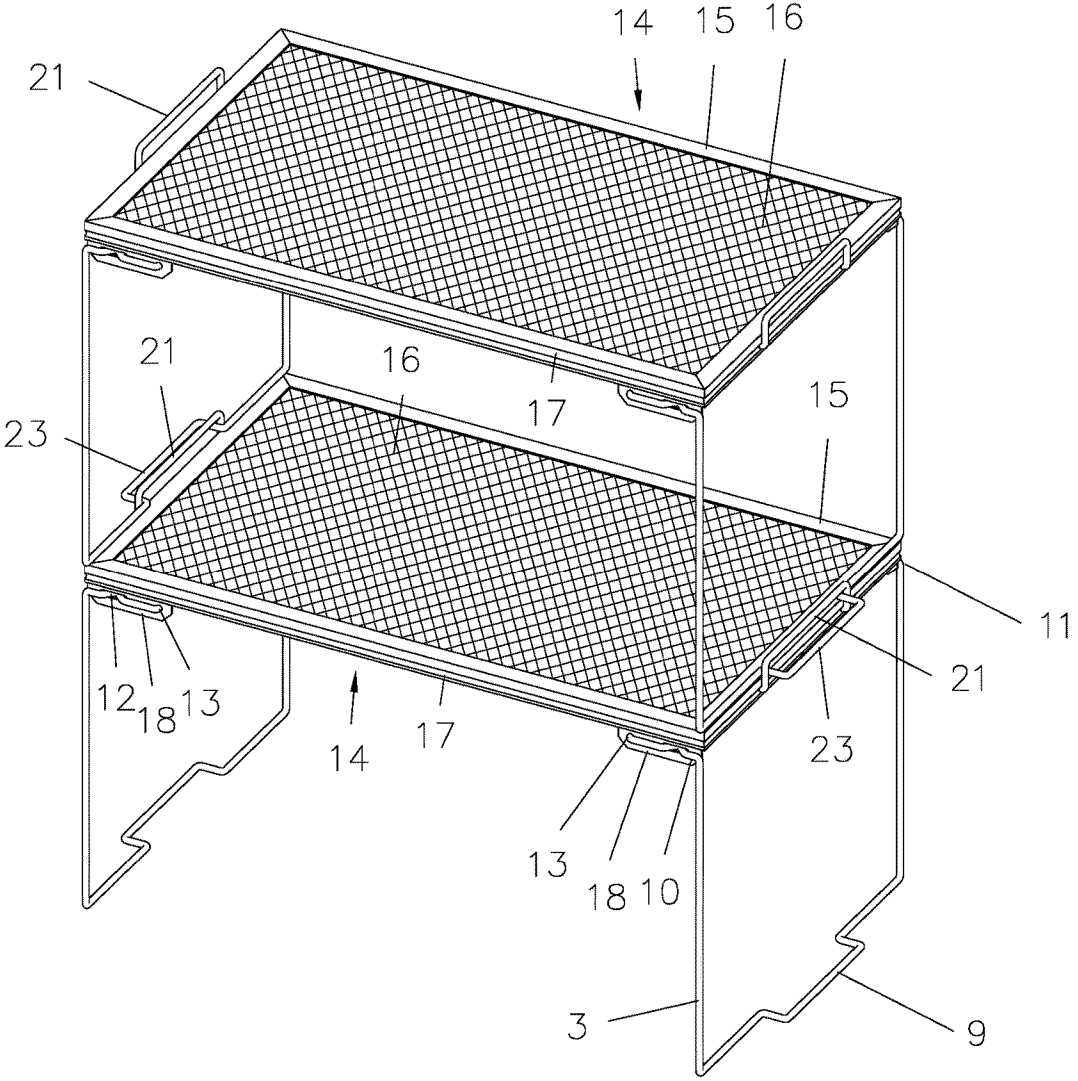
FIG. 10 is a perspective view showing the application of the storage rack according to another preferred embodiment of the present invention.

In another embodiment, as shown in FIGS. 9 and 10, a rectangular plane 16 is formed on a top of a rectangular platform 15 of a storage rack 14 and is made of a metal mesh, wherein the rectangular platform 15 has two long fringes 17, two short fringes 17, and four connection wings 18 extending downward from two sides of the two long fringes 17, wherein a respective connection wing 18 has a circular orifice 19 and an oval or rectangular orifice 20 outside the circular orifice 19, and the storage rack 14 further comprises two grips 21 mounted on the two short fringes 17, wherein a U-shaped mouth of a respective grip 21 faces downward. The four connection wings 18 are one-piece stamped with the rectangular platform 15. In another embodiment, when the rectangular platform 15 is made of a metal plate, the four connection wings 18 are removably connected with the rectangular platform 15. Two support feet 3 are connected on the two long sides of the rectangular platform 15, and an arcuate face 12 of a respective support foot 3 corresponds to a respective oval or rectangular orifice 20 of a respective long fringe 17 of the rectangular platform 15, and an insertion 13 of the respective support foot 3 corresponds to a respective circular orifice 19 of four circular orifices 19 of the respective long fringe 17, such that the insertion 13 is rotatably accommodated into the respective circular orifice 19 of the respective long fringe 17 of the rectangular platform 15 to expand or retract the respective support foot 3 freely. When the respective support foot 3 is erected vertically, the arcuate face 12 of the respective support foot 3 is received into the respective oval or rectangular orifice 20 of the respective long fringe 17. When the arcuate face 12 is movably removed from the respective oval or rectangular orifice 20, the respective support foot 3 is horizontally retracted on a bottom of the rectangular platform 15, thus expending or retracting the respective support foot 3 of the storage rack 1 securely.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A storage rack comprising:

a platform, two support feet, a plane formed on a top of the platform, two first fringes respectively formed on two first sides of the platform and two second fringes respectively formed on two second sides of the platform, two first orifices respectively defined on two sides of each first fringe, a second orifice located adjacent to each first orifices, and two grips respectively mounted on the two second fringes;

wherein the two support feet are respectively connected on the two first sides, and a respective support foot is bent in an U shape, wherein the respective support foot has a first inward bending portion and a second inward bending portion which are respectively formed on two free ends of the respective support foot, wherein each of the first inward bending portion and the second inward bending portion has an arcuate face and an insertion, the arcuate face corresponds to the second orifice of a respective first fringe, and the insertion corresponds to a respective first orifice of the respective first fringe, such that the insertion is rotatably accommodated into the respective first orifice of the respective first fringe to expand or retract the respective support foot freely;

wherein when the respective support foot is erected vertically, the arcuate face of the respective support foot is received into the second orifice of the respective first fringe; when the arcuate face is movably removed from the second orifice, the respective support foot is horizontally retracted onto a bottom of the platform.

2. The storage rack as claimed in claim 1, wherein a respective grip has a U-shaped mouth facing downward.

3. The storage rack as claimed in claim 1, wherein the respective support foot has a closed extension extending outward and connected on two curved portions of the respective support foot.

4. The storage rack as claimed in claim 1, wherein the arcuate face is defined by two bent corners so as to be protruded with respect to the first inward bending portion or the second inward bending portion.

5. The storage rack as claimed in claim 1, wherein the insertion is bent inward with respect to a respective free end of a respective top of the respective support foot.

6. A storage rack comprising:

a platform, two support feet, a plane formed on a top of the platform, two first fringes respectively formed on two first sides of the platform and two second fringes respectively formed on two second sides of the platform, two connection wings respectively extending downward from two sides of each first fringes, and each connection wing having a first orifice and a second orifice adjacent to the first orifice, and two grips respectively mounted on the two second fringes;

wherein the two support feet are respectively connected on the two first sides, and a respective support foot is bent in an U shape, wherein the respective support foot has a first inward bending portion and a second inward bending portion which are respectively formed on two free ends of the respective support foot, wherein each of the first inward bending portion and the second inward bending portion has an arcuate face and an insertion, the arcuate face corresponds to the second orifice of a respective first fringe, and the insertion corresponds to a respective first orifice of the respective first fringe, such that the insertion is rotatably accommodated into the respective first orifice of the respective first fringe to expand or retract the respective support foot freely;

wherein when the respective support foot is erected vertically, the arcuate face of the respective support foot is received into the second orifice of the respective first fringe; when the arcuate face is movably removed from the second orifice, the respective support foot is horizontally retracted onto a bottom of the platform.

7. The storage rack as claimed in claim 6, wherein a respective grip has a U-shaped mouth facing downward.

8. The storage rack as claimed in claim 6, wherein the respective support foot has a closed extension extending outward and connected on two curved portions of the respective support foot.

9. The storage rack as claimed in claim 6, wherein the arcuate face is defined by two bent corners so as to be protruded with respect to the first inward bending portion or the second inward bending portion.

10. The storage rack as claimed in claim 6, wherein the insertion is bent inward with respect to a respective free end of a respective top of the respective support foot.

* * * * *